United States Patent [19]

Bergsoe

[11] 4,456,231

[45] Jun. 26, 1984

[54] APPARATUS FOR REFINING LEAD

[75] Inventor: Svend Bergsoe, Glostrup, Denmark

[73] Assignee: Paul Bergsoe & Son A/S, Glostrup, Denmark

[21] Appl. No.: 452,020

[22] Filed: Dec. 21, 1982

[51] Int. Cl.[3] ..... F27B 3/12

[52] U.S. Cl. ..... 266/215; 75/78; 266/225; 266/229

[58] Field of Search ..... 266/215, 229, 225; 75/78

[56] References Cited

U.S. PATENT DOCUMENTS 2,043,524 6/1936 Williams ..... 75/78

4,294,433 10/1981 Vanjukov et al. ..... 266/215

FOREIGN PATENT DOCUMENTS 256533 11/1963 Australia ..... 75/78

*Primary Examiner*—M. J. Andrews

*Attorney, Agent, or Firm*—Harvey B. Jacobson

[57] ABSTRACT

An apparatus for continuously refining molten crude lead including a furnace for removal of antimony from the crude lead regardless of whether the crude lead does or does not contain arsenic and/or tin. The furnace is of the reverberatory type having a plurality of transverse walls dividing the interior thereof and thus the lead into a number of distinct but connected compartments with the passageways through the transverse walls being staggered so that molten lead passes along a zigzag or tortuous path through the furnace which is lined with a refractory material. Air is injected into the molten crude lead as it passes from the inlet end of the furnace to the discharge end for progressive softening of the crude lead. The low antimony content slags produced near the lead discharge end of the furnace becomes progressively enriched in antimony as they react with the higher antimony content metal as they pass toward the lead inlet end where they are discharged at a slag overflow device. A solid reducing agent, such as coal, may be added to the surface of the slag or an organic gas capable of reducing lead oxide to lead may be injected into the crude lead or the slag layer to increase its antimony content and reduce the weight of the slag.

5 Claims, 4 Drawing Figures

APPARATUS FOR REFINING LEAD

BACKGROUND OF THE INVENTION

1. Field of the Invention

The present invention generally relates to an apparatus for continuously refining molten crude lead and more particularly to a furnace for the removal of antimony from the molten crude lead which may or may not contain arsenic and/or tin.

2. Description of the Prior Art

Softening, as the process is termed in this field of endeavor, is usually carried out in a reverberatory furnace or in a kettle as a batch process. In its simplest form, air is blown into the molten metal to oxidize the impurities which, dependent upon the temperature, rise to the surface of the bath in the form of a powdery scum or as a molten slag. If substantial quantities of tin are present, a dry powdery scum is always produced at the normal working temperature below 1000° C. until the tin content, which oxidizes preferentially to arsenic and antimony, is reduced to the order to 0.2%. Below this amount, tin is oxidized together with arsenic and antimony and provided that the temperature is maintained at a high enough level, the oxidation products form a molten slag which floats on the surfaces of the metal.

The addition of fluxes such as caustic soda enable the oxidation to be carried out at lower temperatures thus making the process suitable for operation in a steel pot or kettle rather than in a more expensive refractory-lined furnace.

However, at nearly all lead smelters in the world, softening, whether at a higher temperature in a furnace or at a lower temperature in a kettle, is carried out as a batch operation which makes this process expensive in terms of the equipment used and the time required in carrying out the process. In one notable exception, air is blown into a bath of lead held in a small reverberatory furnace to oxidize the arsenic and antimony. Lead containing approximately 0.2% arsenic and 0.8% antimony is added to the bath at one end and softened lead with 0.03% antimony overflows through a specially shaped siphon device at the other. Lead is softened at the rate of nearly 30 tons per hour with a very small labor requirement and little other expense except for supplying the air and repairing the furnace. More importantly, good hygiene can be maintained around a small continuous unit compared with the difficulties of large batch units. One disadvantage of this type of operation is the necessity of maintaining the antimony content of the bath at the same level as desired in the softened product. In the case of the above mentioned process, the antimony content is maintained at 0.03%. It is well known in the art that a form of equilibrium exists between the antimony content of the lead oxide-antimony oxide slag and the antimony content of the lead that it is in contact with. Maintaining the bath of lead at a low antimony content inevitably means that the slag produced has a low antimony content or put in other terms for a given amount of antimony oxidized, a larger weight of by-product, which will incur an expense in its re-treatment will be produced. The relationship between the antimony content of a bath of lead and the slag in contact with it is well known and was presented in a publication of Dr. T.R.A. Davey-Proc. A.I.M.E. Symposium *Lead-Tin Zinc* '80 Las Vegas, February 1980, p. 489.

SUMMARY OF THE INVENTION

It is an object of the present invention to soften lead continuously while producing the smallest possible quantity of slag with a high antimony content so that re-treatment costs are kept at a minimum which can be accomplished by utilizing a novel type of reverberatory furnace.

Another object of the invention is to provide an apparatus for continuously refining molten crude lead employing a reverberatory furnace having a plurality of transverse walls defining interconnected compartments to define a zigzag flow path through the furnace together with means for introducing air into the molten lead as it flows from an inlet end to the discharge end for progressive softening thereof with the low antimony content slags produced near the discharge end of the furnace becoming progressively enriched in antimony content as they react with the higher antimony content metal as the slags pass toward the lead inlet end from which they are discharged at an overflow device at the lead inlet end of the furnace.

Still another object of the present invention is to provide a lead refining apparatus which is efficient in operation, reduces labor and cost and maintains clean environmental conditions in the area associated with the apparatus.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
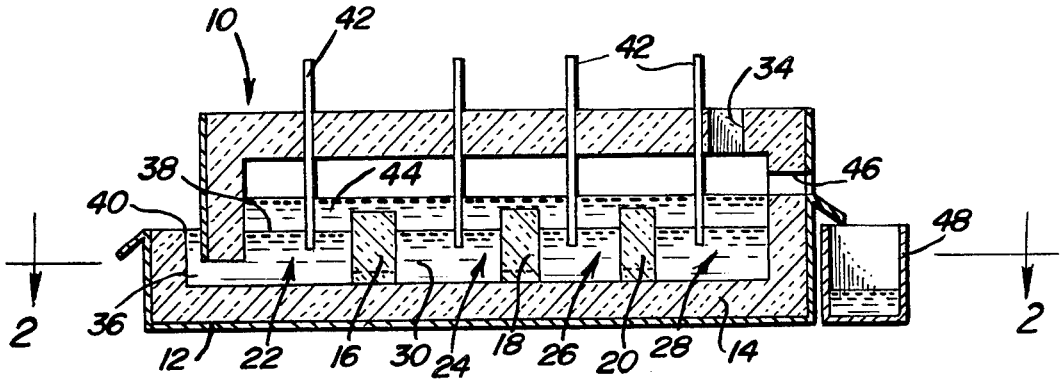
FIG. 1 is a longitudinal sectional view of one embodiment of the apparatus of the present invention.
Figure 2:
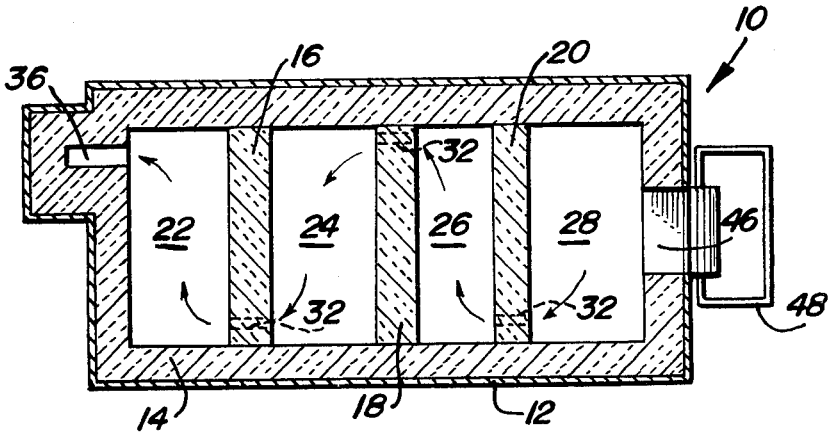
FIG. 2 is a plan sectional view taken substantially upon a plane passing along section line 2—2 on FIG. 1 illustrating the relationship of the structural components of the furnace.

Referring now specifically to the drawings, the lead refining apparatus of the present invention includes a reverberatory furnace 10 in which FIG. 1 and 2 illustrate one embodiment of this invention.

The furnace 10 comprises a steel shell 12 lined with a refractory material 14 of a type resistant to the corrosive action of lead oxide-antimony oxide slags. Three cross walls or transverse walls 16, 18 and 20 are illustrated, but the invention is not limited to this number. These cross walls create four separate compartments 22, 24, 26 and 28 containing the molten lead 30 in the lower portion thereof. The chambers are connected by openings 32 in the base of each cross wall with the openings being staggered so that the molten lead is forced to take the longest path as illustrated in FIG. 2.

Molten crude lead, preferably at a temperature above 650° C., enters the furnace 10 through an inlet opening 34 at one end as illustrated and overflows by means of a siphon device 36 at the other end. The lead level 38 within the furnace 10 can be controlled by altering the level of the overflow weir 40 by either adding or subtracting thin layers of brick or clay. Air is blown into the molten crude lead 30 by a number of lances 42 constructed of mild steel, cast iron or slag resistant refractory material with at least one lance being positioned to discharge in each chamber or compartment. A lead oxide-antimony oxide slag layer 44 is generated and flows back along the furnace 10 toward the chamber 28 in which the unsoftened lead was received. The slag 44 overflows by means of a weir or taphole 46 into an awaiting receptacle 48.

In flowing back along the furnace, the low antimony content slag produced in chamber 22 where it has been in contact with low antimony content metal, reacts with the progressively higher antimony content metal to give a higher antimony content slag. By reacting in chamber 28 with the incoming lead, the highest possible antimony content in the slag is obtained. The exact content of antimony in the slag will be dependent on the antimony content of the incoming lead with which it is in contact.

In a variation of the process, the antimony content of the slag in chamber 28 can be enhanced further by the addition of a small quantity of a solid reducing agent, such as coal, charcoal or other carbon-containing reducing agent of low ash content, sprinkled over the surface of the slag 44 through the opening 34 or the like. In this case, the amount of air blown into the molten unsoftened lead in chamber 28 is limited to providing a stirring action or turbulence to ensure mixing of the slag 44 and reducing agent. The action of the limited quantity of reducing agent is to cause a preferential reduction of lead oxide from the lead oxide-antimony oxide slag before the slag leaves the furnace, thus reducing still further the quantity of slag required to be retreated and at the same time enhancing its antimony content.

Alternatively, this same effect can be obtained by omitting the addition of the reducing agent and omitting the injection of air into chamber 28 and in their place, injecting a hydrocarbon gas or other organic gas of similar reducing ability, which will reduce lead oxide preferentially from the lead oxide-antimony oxide slag.

Most crude lead arising from primary sources, such as obtained by smelting lead minerals, contains arsenic and antimony in varying proportions but little or no tin. However, lead obtained from secondary sources, such as from scrap or recycled materials can contain tin and/or arsenic in addition to the antimony which must be removed if soft lead is required. The presence of tin above 0.2% reduces the fluidity of lead oxide-antimony oxide slags and above 0.5% tin, powdery scums are produced instead of a liquid slag.

Figure 3:
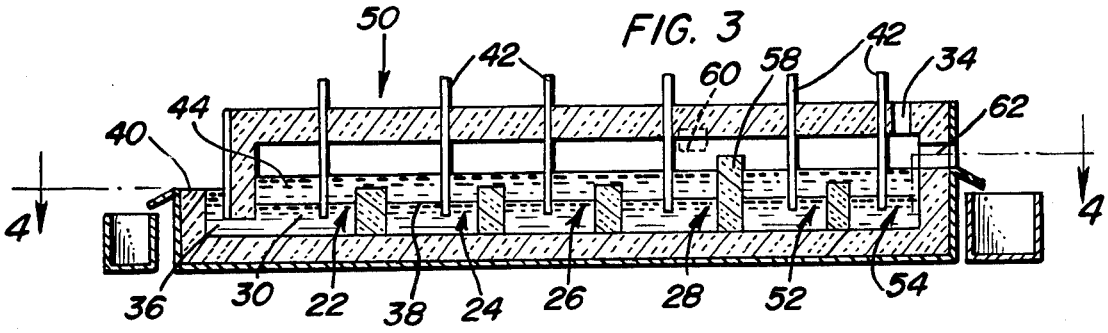
FIG. 3 is a longitudinal, vertical sectional view of another embodiment of the apparatus of the present invention.
Figure 4:
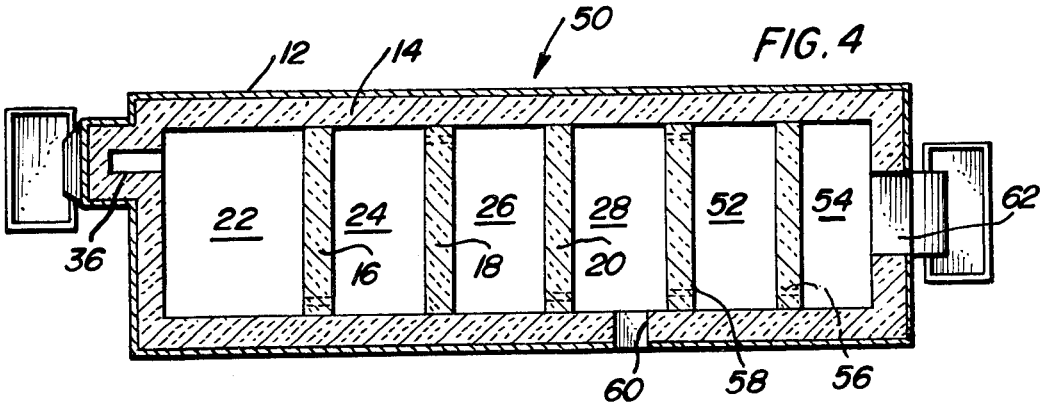
FIG. 4 is a plan sectional view taken substantially upon a plane passing along section line 4—4 on FIG. 3 illustrating the structural features of this embodiment of the invention.

The presence of tin above 0.2% in the unsoftened lead can be used to advantage by the adoption of a further variation in which one or more additional chambers are added to a furnace for dealing with the arsenic and antimony as previously described. FIGS. 3 and 4 illustrate such a modified furnace 50 in which additional chambers 52 and 54 have been added. These two chambers are interconnected by a submerged opening 56 and in a similar manner are connected to chamber 28. Crude lead at a temperature in excess of 650° C. enters chamber 54 and after reacting with air injected by one or more supply pipes 42 passes to chamber 52 where it reacts with further air injected into the bath. The metal then passes through the chambers 28 to 22 inclusive before overflowing as nearly soft lead. However, the wall 58 between chamber 28 and chamber 52 is constructed with additional bricks or refractory material to provide a height sufficient that the slags arising from the softening in the chambers 22 to 28 inclusive cannot come into contact with the products of the oxidation carried out in chambers 52 and 54. As illustrated in FIG. 4, the slag arising from the oxidation in chambers 22 to 28 overflows from a taphole or weir 60 located in one external wall of chamber 28 and the products of oxidation in chambers 52 and 54 can be removed over a weir 62 in one of the external walls of chamber 54. The products of oxidation in chambers 52 and 54 in the absence of any fluxing agent will be a powdery scum, but by the addition of sufficient fluxing agent to either chamber 52 or chamber 54 or to both, a fluid reaction product can be obtained. This is advantageous in that it can be tapped either continuously or intermittently without the inherent difficulties of handling dry powdery lead-containing materials, especially from the point of view of controlling the amount of lead in the working atmosphere or environment.

By dividing the furnace 50 into two distinct parts, one part dealing with the removal of tin contained in the incoming crude lead, comprising chambers 52 and 54, and the other part dealing with the removal of antimony contained in the incoming crude lead, comprising chambers 22 to 28 inclusive, a tin-containing by-product reasonably low in antimony content can be obtained suitable for the recovery of tin, and an antimony-containing by-product low in tin content can be obtained suitable for the recovery of antimony as antimonial lead or with further treatment as lead and antimony. In order to achieve the optimum separation between tin and antimony, the oxidation of tin should take place in the presence of sufficient fluxing agent, such as caustic soda, to give a liquid product and the degree of oxidation controlled by the amount of air injected in a sufficient number of chambers, that the partially softened lead passing from the tin removal section to the antimony removal section, such as from chamber 52 to chamber 28, does not exceed 0.2% tin.

Throughout the description, the term "air" has been used since it is the most common and cheapest form of oxygen-containing gas. In certain circumstances, when tonnage oxygen is available for other purposes, or inexpensive oxygen is available, oxygen could be used alone or in addition to the air injected into the bath. In certain circumstances, it may be advantageous to vary the volume of molten lead contained in any one or more chambers relative to any other to facilitate an increase in the number of lances to inject the air or oxygen-enriched air or the time available for partial reduction at that point in the furnace.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for continuously refining crude molten lead comprising a refractory lined elongate furnace having a crude lead inlet means at one end portion thereof, a refined molten lead outlet means at the other end portion thereof and a slag outlet means in the same end portion as the inlet means, said slag outlet means being at a higher elevation than the molten lead outlet means, said furnace including a plurality of transversely extending divider walls dividing the furnace into a plurality of transverse chambers, each wall having a passage therethrough below the level of the molten lead outlet means with the passages being staggered to provide a flow path for molten lead, the upper edge of each of the divider walls being between the level of the molten lead outlet means and the slag outlet means to enable slag to overflow the upper edge of the walls during flow from the end portion of the furnace having the molten lead outlet means toward the end portion of the furnace having the slag outlet means therein, and means introducing a reducing agent into the molten lead in the furnace.

2. The apparatus of claim 1 wherein said means for introducing a reducing agent comprises an air injection lance extending into each chamber and extending into the molten lead.

3. The apparatus of claim 1 wherein said means for introducing a reducing agent comprises means injecting a hydrocarbon or other organic gas into at least one of said chambers.

4. The apparatus of claim 1 wherein said means for introducing a reducing agent comprises said lead inlet means including means for introducing coal or similar solid reducing agent into said furnace.

5. The apparatus as defined in claim 1 together with an additional divider wall having its upper edge disposed above the level of the slag outlet means to prevent slag from overflowing the upper edge thereof, said additional divider wall having a passage therethrough below the level of the molten lead outlet means, said additional divider wall being disposed in longitudinally spaced but adjacent relation to the crude lead inlet means and slag outlet means to form an additional transverse chamber, said furnace including an additional slag outlet means disposed laterally adjacent the upper edge of the additional divider wall and on the side thereof opposite to the crude lead inlet means.

* * * * *